US009520685B2

(12) United States Patent
Zhao et al.

(10) Patent No.: US 9,520,685 B2
(45) Date of Patent: Dec. 13, 2016

(54) ELECTRICAL CONNECTOR HAVING SIDEWARDLY EXPOSED CONTACTS

(71) Applicant: FOXCONN INTERCONNECT TECHNOLOGY LIMITED, Grand Cayman (KY)

(72) Inventors: Jun Zhao, Kunshan (CN); Jing-Jie Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/833,156

(22) Filed: Aug. 24, 2015

(65) Prior Publication Data

US 2016/0056591 A1 Feb. 25, 2016

(30) Foreign Application Priority Data

Aug. 22, 2014 (CN) ..... 2014 2 0476480 U

(51) Int. Cl.

| | |
|---|---|
| ***H01R 24/58*** | (2011.01) |
| ***H01R 12/70*** | (2011.01) |
| ***H01R 12/72*** | (2011.01) |
| *H01R 107/00* | (2006.01) |

(52) U.S. Cl.

CPC ..... *H01R 24/58* (2013.01); *H01R 12/7076* (2013.01); *H01R 12/721* (2013.01); *H01R 2107/00* (2013.01)

(58) Field of Classification Search

CPC ..... H01R 24/58

USPC ..... 439/668, 669

See application file for complete search history.

(56) References Cited

U.S. PATENT DOCUMENTS

| | | | | |
|---|---|---|---|---|
| 6,312,274 | B1 * | 11/2001 | Lin | H01R 24/58 439/188 |
| 6,364,717 | B1 * | 4/2002 | Lin | H01R 13/627 439/668 |
| 6,368,156 | B1 * | 4/2002 | Lin | H01R 24/76 439/188 |
| 6,478,629 | B1 * | 11/2002 | Li | H01R 24/58 439/668 |
| 6,568,963 | B2 * | 5/2003 | Zhang | H01R 24/58 439/668 |
| 6,575,793 | B1 * | 6/2003 | Li | H01R 24/58 439/188 |
| 6,592,408 | B2 | 7/2003 | Ma | |
| 6,690,801 | B2 * | 2/2004 | Yeh | H01R 24/58 381/77 |
| 6,808,404 | B1 * | 10/2004 | Doyle | H01R 13/7031 200/51.1 |

(Continued)

FOREIGN PATENT DOCUMENTS

| | | |
|---|---|---|
| CN | 203434343 | 2/2014 |
| TW | 201025760 | 7/2010 |

*Primary Examiner* — Ross Gushi

(74) *Attorney, Agent, or Firm* — Wei Te Chung; Ming Chieh Chang

(57) ABSTRACT

An electrical connector includes: an insulating body having an upper face and a lower face, two opposite side faces, a front face and a rear face, and a plug-receiving hole; and a number of terminals mounted to the insulating body, each terminal having a holding portion, an elastic portion extending into the hole, and an abutment portion. The abutment portion is movably exposed to a corresponding side face.

18 Claims, 4 Drawing Sheets

(56) References Cited

U.S. PATENT DOCUMENTS 7,033,226 B1 * 4/2006 Chien ..... H01R 13/2442 439/668
7,147,497 B1 * 12/2006 Liao ..... H01R 13/7031 200/51.1
7,238,059 B1 * 7/2007 Wu ..... H01R 13/41 439/668
7,285,024 B1 * 10/2007 Tai ..... H01R 12/707 439/188
7,387,543 B1 * 6/2008 Wu ..... H01R 24/58 439/668
7,445,515 B1 * 11/2008 Yuan ..... H01R 24/38 439/668
7,534,146 B2 * 5/2009 Chien ..... H01R 24/58 439/668
7,568,929 B1 * 8/2009 Su ..... H01R 13/7033 439/188
7,591,685 B2 * 9/2009 Zhu ..... H01R 12/57 439/668
7,637,787 B2 * 12/2009 Chien ..... H01R 24/58 439/668
7,645,170 B2 * 1/2010 Long ..... H01R 13/5202 439/668
7,648,400 B2 * 1/2010 Zhu ..... H01R 24/58 439/188
7,654,872 B2 * 2/2010 Lin ..... H01R 24/58 439/668
7,717,753 B2 * 5/2010 Chen ..... H01R 24/58 439/607.01
7,717,755 B2 * 5/2010 Zhang ..... H01R 24/58 439/669
7,753,738 B2 * 7/2010 Zhang ..... H01R 13/52 439/519
7,775,837 B2 * 8/2010 Zhang ..... H01R 13/6277 439/669
7,789,712 B1 * 9/2010 Peng ..... H01R 24/58 439/668
7,794,285 B1 * 9/2010 Huang ..... H01R 24/58 439/668
7,806,734 B1 * 10/2010 Yu ..... H01R 24/58 439/668
7,833,032 B1 * 11/2010 Yu ..... H01R 13/703 439/188
7,874,876 B1 * 1/2011 Huang ..... H01R 24/58 439/668
7,887,376 B1 * 2/2011 Zhang ..... H01R 13/6594 439/108
7,896,706 B1 * 3/2011 Peng ..... H01R 13/111 439/668
7,901,251 B1 * 3/2011 Chen ..... H01R 13/7032 439/668
7,922,542 B1 * 4/2011 Shu ..... H01R 24/58 439/188
7,959,472 B1 * 6/2011 Huang ..... H01R 13/20 439/668
7,963,784 B1 * 6/2011 Su ..... H01R 13/703 439/188
7,963,786 B1 * 6/2011 Su ..... H01R 24/58 439/271
7,963,807 B1 * 6/2011 Yang ..... H01R 24/58 439/668
8,002,564 B2 * 8/2011 Cao ..... H01R 13/5227 439/205
8,100,726 B2 * 1/2012 Harlan ..... H01R 13/2414 29/883
8,215,989 B2 * 7/2012 Tamm ..... H01R 13/6594 381/1
8,216,000 B2 * 7/2012 Su ..... H01R 13/7033 200/51.1
8,251,753 B2 * 8/2012 Guo ..... H01R 12/57 439/668
8,287,314 B1 * 10/2012 Gao ..... H01R 13/7033 439/668
8,579,665 B2 * 11/2013 Yu ..... H01R 12/724 439/607.35
8,662,937 B2 * 3/2014 Tian ..... H01R 12/716 439/668
8,678,863 B2 * 3/2014 Nagata ..... H01R 13/5213 439/606
8,808,035 B2 * 8/2014 Wu ..... H01R 24/58 439/668
8,939,793 B1 * 1/2015 de la Fuente ..... H01R 24/58 29/842
9,118,122 B2 * 8/2015 Liu ..... H01R 4/18
9,130,302 B1 * 9/2015 Yang ..... H01R 13/521
9,153,919 B2 * 10/2015 Tamm ..... H01R 13/6594
9,178,323 B2 * 11/2015 Ju ..... H01R 12/722
9,219,330 B2 * 12/2015 Shin ..... H01R 13/60
2006/0030219 A1 * 2/2006 Huang ..... H01R 24/58 439/669
2006/0160427 A1 * 7/2006 Yin ..... H01R 24/50 439/668
2006/0234563 A1 * 10/2006 Yang ..... H01R 24/58 439/668
2006/0264116 A1 * 11/2006 Chung ..... H01R 24/64 439/668
2007/0127764 A1 * 6/2007 Yang ..... H01R 13/415 381/384
2007/0232150 A1 * 10/2007 Lee ..... H01R 24/58 439/668
2007/0249235 A1 * 10/2007 Wu ..... H01R 13/41 439/668
2008/0247591 A1 * 10/2008 Yang ..... H01R 24/58 381/384
2009/0011629 A1 * 1/2009 Wang ..... H01R 24/58 439/188
2009/0149080 A1 * 6/2009 Wu ..... H01R 12/57 439/668
2009/0291598 A1 * 11/2009 Cheng ..... H01R 13/506 439/668
2009/0298347 A1 * 12/2009 Wu ..... H01R 13/7033 439/668
2010/0055989 A1 * 3/2010 Su ..... H01R 24/58 439/675
2011/0104956 A1 * 5/2011 Guo ..... H01R 12/57 439/668
2011/0183536 A1 * 7/2011 Wang ..... H01R 24/58 439/188
2015/0050835 A1 2/2015 Ju
2015/0155663 A1 * 6/2015 Zwartkruis ..... H01R 13/5202 439/188
2015/0349475 A1 * 12/2015 Yudate ..... H01R 24/58 439/668
2016/0049755 A1 * 2/2016 Ning ..... H01R 24/58 439/587
2016/0056591 A1 * 2/2016 Zhao ..... H01R 12/721 439/668

* cited by examiner

ELECTRICAL CONNECTOR HAVING SIDEWARDLY EXPOSED CONTACTS

BACKGROUND OF THE INVENTION

1. Field of the Invention

The present invention relates to an electrical connector, and more particularly to an audio jack connector mounted in a sinking manner to a printed circuit board and having contacts so structured that a height of the connector relative to the printed circuit board can be adjusted.

2. Description of Related Art

TW 201025760, published on Jul. 1, 2010, discloses an audio jack connector comprising an insulating body and a plurality of terminals fixed to the insulating body. Each terminal includes a resilient mounting portion extending out of a bottom wall of the insulating body for compression contact against a printed circuit board (PCB) on which the audio jack connector is mounted. Such connector is not adapted for sink-type board-mounting where a bottom of the connector is at a height or leveled below a top of the PCB.

US 2015/0050835, published on Feb. 19, 2015, discloses sink-type audio jack connectors meeting market demands of various height specifications. Specifically, a height difference between a center of the connector and a PCB can be changed by employing terminals that have abutment portions of different heights or vertical dimensions.

There is a need for achieving different heights of board-mounted connectors relative to a PCB a new receptacle connector is to solve the above technical problem.

SUMMARY OF THE INVENTION

An electrical connector includes: an insulating body having an upper face and a lower face, two opposite side faces, a front face and a rear face, and a plug-receiving hole; and a number of terminals mounted to the insulating body, each terminal having a holding portion, an elastic portion extending into the hole, and an abutment portion. The abutment portion is movably exposed to a corresponding side face.

DETAILED DESCRIPTION OF THE PREFERRED EMBODIMENT

Figure 1:
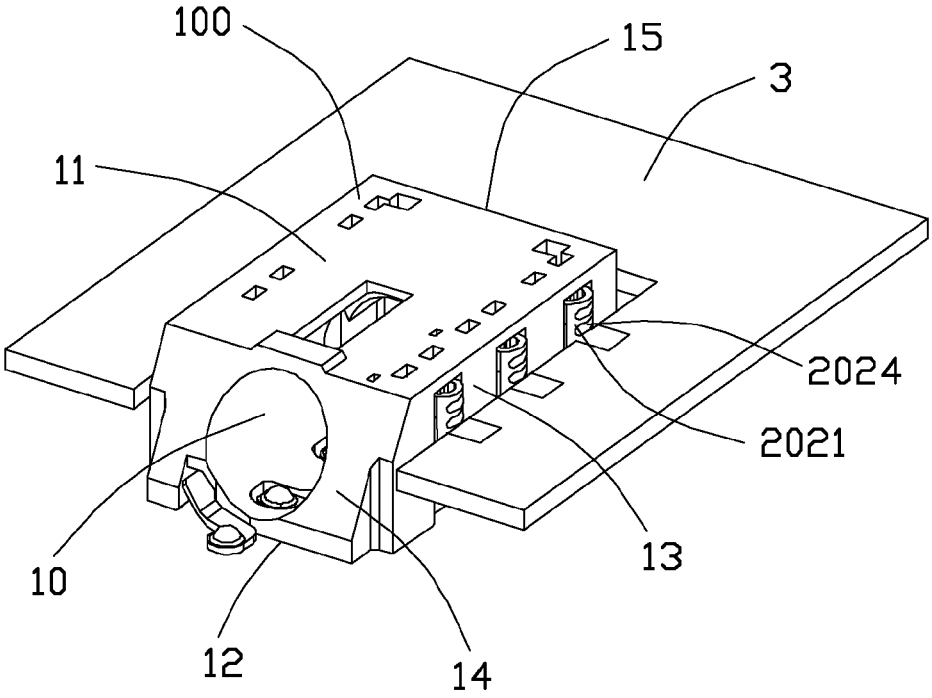
FIG. 1 is an assembled perspective view showing an audio jack connector in accordance with the present invention mounted in a sinking manner to a printed circuit board.
Figure 2:
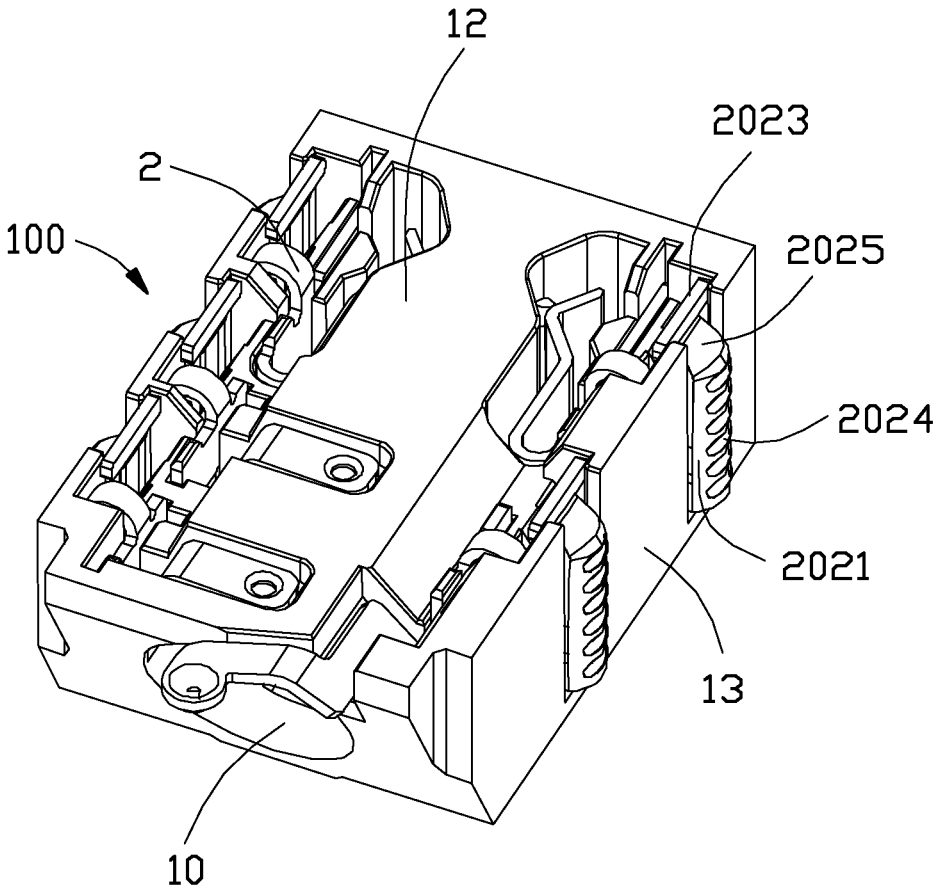
FIG. 2 is a bottom perspective view of the audio jack connector in FIG. 1.

Referring to FIGS. 1-4, an electrical connector 100, an audio jack connector in the embodiment shown, comprises an insulating body 1 having a plug-receiving hole 10 and a plurality of terminals 2 secured to the insulating body. Also disclosed is a printed circuit board (PCB) 3 for mounting the connector 100.

The insulating body is substantially of a rectangular parallelepiped shape and comprises an upper face 11 and a lower face 12, two opposite side faces 13, and a front face 14 and a rear face 15. The plug-receiving hole 10 extends from the front face 14 toward the rear face 15. The insulating body 1 comprises a plurality of terminal receiving grooves 120 exposing to the lower face 12.

Each of the terminal receiving grooves 120 has a retaining portion 1201, an outer portion 1202 outwardly of the retaining portion, and an inner portion 1203 inwardly of the retaining portion. The plug-receiving hole 10 is in fluid communication with the inner portion 1203. The outer portion 1202 has an opening 1200 through the side face 13.

As the embodiment shows, the terminals 2 include a pair of first terminals 21, a pair of second terminals 22, and a third terminal 23.

Figure 3:
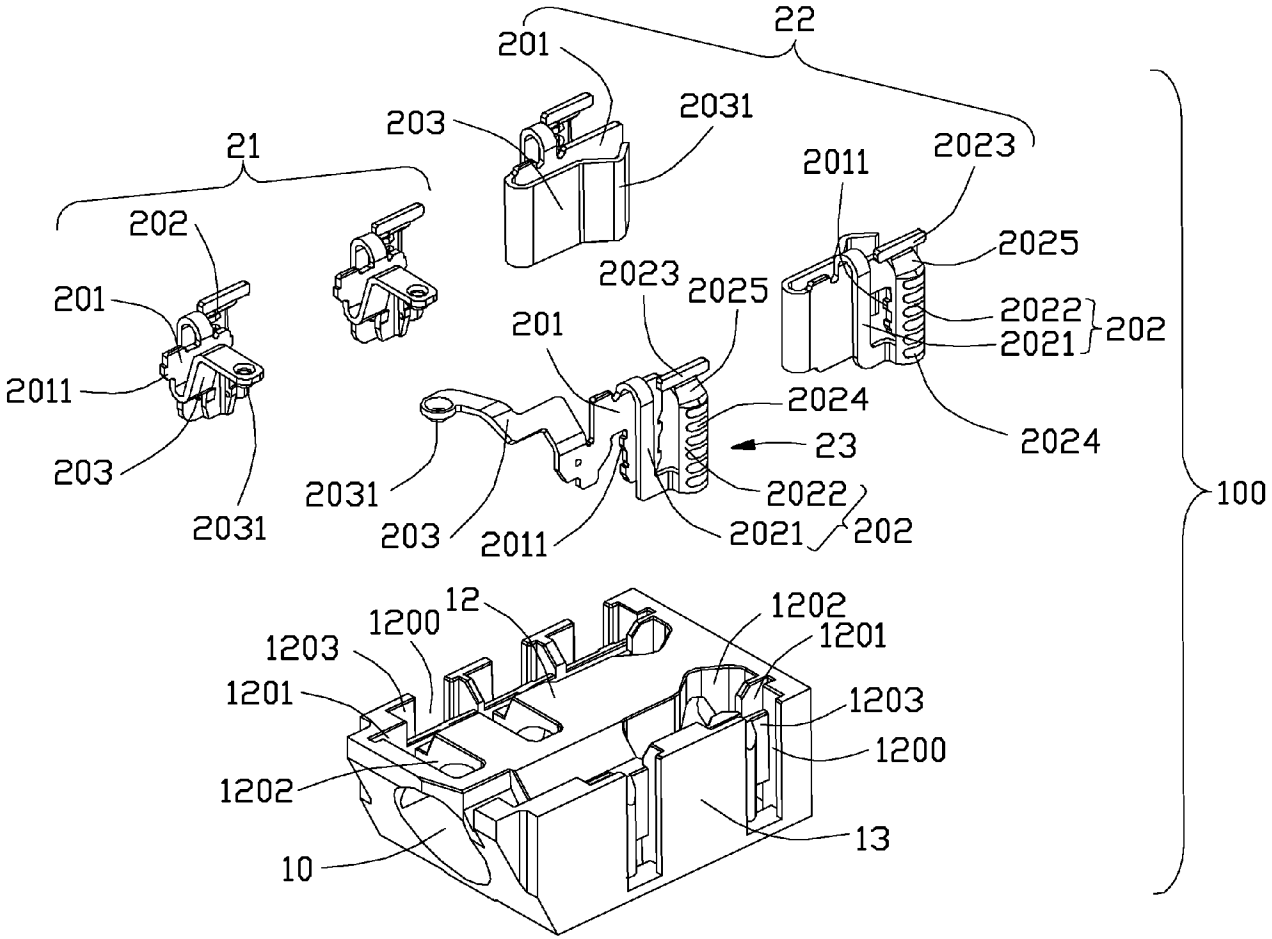
FIG. 3 is an exploded view of the audio jack connector.
Figure 4:
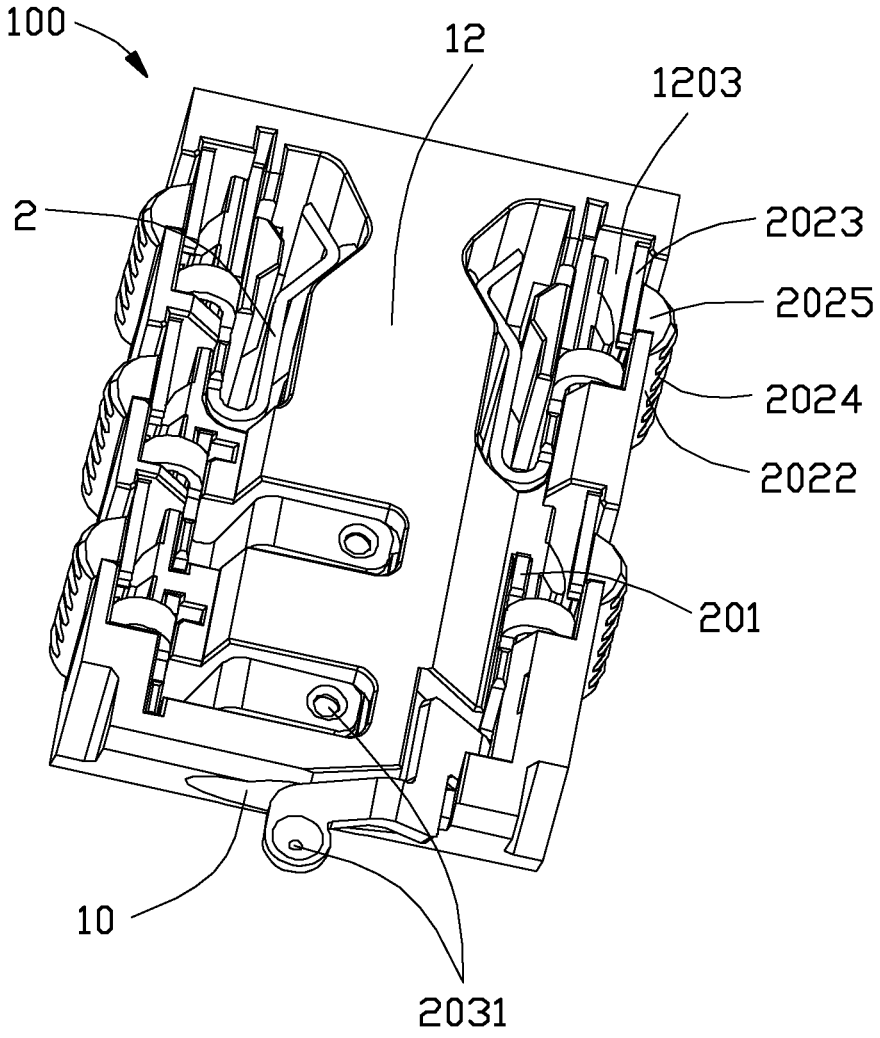
FIG. 4 is another bottom perspective view of the audio jack connector.

Referring specifically to FIGS. 3 and 4, each terminal comprises a holding portion 201 secured to the retaining portion 1201, an elastic portion 203 extending into the hole 10, and an abutment portion 202 received in the outer portion 1202. The abutment portion 202 and the elastic portion 203 are located on two opposite sides of the holding portion 201. The holding portion 201 has barbs 2011 for interference fit purpose. The abutment portion 202 is movably exposed to a corresponding side face 13 so that it can be pressed by a side edge of a notch (not labeled) formed on the PCB 3 to which the electrical connector 10 is mounted. That is, the abutment portion 202 is elastically deformable in a direction perpendicular to a general plane of the associated side face 13.

The elastic portion 203 of the first terminal 21 is formed by downwardly bending from an upper edge portion of the holding portion 201. The elastic portion 203 of the second terminal 22 is formed by rearwardly bending from a front edge portion of the holding portion 201. The elastic portion 203 of the third terminal 23 is formed by bending and forwardly extending from a front edge portion of the holding portion 201.

Each of the elastic portion 203 of the first terminal 21 and the elastic portion 203 of the third terminal 23 has a contacting portion 2031 in the form of a convex projection. The elastic portion 203 of the second terminal 21 has a contacting portion 2031 in the form of an elongated ridge.

Each of the abutment portions 202 of the first terminal 21, the second terminal 22, and the third terminal 23 is formed by upwardly bending from a lower edge portion of the associated holding portion 201 so that the abutment portion 202 and the holding portion 201 are disposed substantially opposing each other along a sideward direction. The abutment portion 202 includes a pressing portion 2022 and a connecting portion 2021 connected between the pressing portion 2022 and the holding portion 201. The pressing portion 2022 protrudes through the opening 1200 of the side face 13 outwardly of the insulating body 1. Each of the pressing portion 2022 and the connecting portion 2021 extends along a vertical direction. A lower end of the connecting portion 2021 is connected to the holding portion 201, and an upper end of the pressing portion 2022 is connected to an upper end of the connecting portion 2021. The pressing portion 2022 and the connecting portion 2021 are side by side, substantially aligned along an extension direction of the plug-receiving hole 10. The pressing portion 2022 has an inclined surface 2025 at a free end thereof. The pressing portion 2022 also has a plurality of positioning portions 2024 at an exterior side face thereof. In the embodiment shown, the positioning portions 2024 are in the form of ridges between consecutive valleys. A vertical distance between two adjacent ridges, i.e., pitch, is less than a thickness of the PCB 3 to ensure proper contact. The abutment portion 2022 thither may be provided with a pre-stress portion 2025. The pre-stress portion 2025 extends across the opening 1200 of the side face 13 and presses against the insulating body 1 to achieve a positive engagement with the PCB notch when the connector 100 is mounted to the PCB 3.

In the embodiment shown, both the connecting portion 2021 and the pressing portion 2022 of the abutment portion 202 can deform resiliently in the width direction of the connector 100, i.e., the direction perpendicular to the side 13. The inclined surface 2025 of the pressing portion 2022 assists in guiding the pressing portion 2022 during mounting the connector 100 to the PCB 3. Understandably, to assure the movement of the connector relative to the PCB 3 in the vertical direction, the PCB 3 may optionally form through holes, and the connector may be optionally equipped with the side posts moveably received within the corresponding through holes in the vertical direction.

What is claimed is:

1. An electrical connector comprising:

an insulating body having an upper face and a lower face, two opposite side faces, a front face and a rear face, and a plug-receiving hole; and a plurality of terminals mounted to the insulating body, each terminal comprising a holding portion, an elastic portion extending into the hole, and an abutment portion, the abutment portion being movably exposed to a corresponding side face; wherein the insulating body has a respective opening exposed to a corresponding side face, and the abutment portion includes a pressing portion and a connecting portion between the pressing portion and the holding portion, the pressing portion protruding through the opening outwardly of the insulating body; wherein the pressing portion and the connecting portion are substantially aligned along an extension direction of the plug-receiving hole.

2. The electrical connector according to claim 1, wherein the abutment portion and the holding portion are disposed substantially opposing each other along a sideward direction.

3. The electrical connector according to claim 1, wherein the insulating body comprises a plurality of terminal receiving grooves exposing to the lower face.

4. The electrical connector according to claim 1, wherein each of the pressing portion and the connecting portion extends along a vertical direction, a lower end of the connecting portion is connected to the holding portion, and an upper end of the pressing portion is connected to an upper end of the connecting portion.

5. The electrical connector according to claim 1, wherein the pressing portion has an inclined surface at a free end thereof.

6. The electrical connector according to claim 1, wherein the pressing portion has a plurality of positioning portions at an exterior side face thereof.

7. The electrical connector according to claim 1, wherein the abutment portion has a pre-stress portion pressing against the insulating body.

8. An electrical connector for use with a plug, comprising:

an insulative housing defining a pair of outwardly exposed side faces opposite to each other in a transverse direction, and a plug receiving hole extending along a front-to-back direction perpendicular to said transverse direction for receiving the plug;

a plurality of terminals mounted to the housing, each of said terminals defining a contacting section extending into the plug receiving hole for responding to the plug, and an abutment portion exposed upon the corresponding side face and moveable in said transverse direction for mechanical engagement within a notch of a printed circuit board and electrical connection to a corresponding conductive pad around said notch on said printed circuit board.

9. The electrical connector as claimed in claim 8, wherein said contacting section is elastic to be adapted to directly mechanically and electrically connect the plug.

10. The electrical connector as claimed in claim 9, wherein said contacting section is equipped with a horizontal U-shaped structure to provide resiliency thereof in the transverse direction.

11. The electrical connector as claimed in claim 8, wherein said housing further defines an upper face and a lower face opposite to each other in a vertical direction perpendicular to both said transverse direction and said front-to-back direction, and the housing and said terminals are configured to allow said terminals to be assembled into the housing in the vertical direction only.

12. The electrical connector as claimed in claim 11, wherein each of said terminals includes an upstanding U-shaped structure linked between the abutment portion and the contacting section to provide resiliency of said abutment portion in said transverse direction.

13. The electrical connector as claimed in claim 12, wherein each of said terminals further includes for securing to the housing a holding portion associated with the contacting section and commonly located on a same side of said U-shaped structure with the contacting section.

14. The electrical connector as claimed in claim 8, wherein an exterior surface of the abutment portion defines a plurality of positioning portions in a form of ridges between consecutive valleys, and a width of the valley is less than a thickness of the printed circuit board.

15. The electrical connector as claimed in claim 14, wherein the electrical connector is adapted to be retained within the notch at different levels with regard to the printed circuit board via engagement between the printed circuit board and the different ridges.

16. An electrical connector for use with a plug, comprising:

an insulative housing defining a pair of outwardly exposed side faces opposite to each other in a transverse direction, and a plug receiving hole extending along a front-to-back direction perpendicular to said transverse direction for receiving the plug;

a plurality of terminals mounted within the housing, each of said terminals defining a holding section for securing to the housing, and an abutment portion located around the holding portion with an elastic structure therebetween and exposed upon the corresponding side face and moveable in said transverse direction for mechanical engagement within a notch of a printed circuit board and electrical connection to a corresponding conductive pad around said notch on said printed circuit board.

17. The electrical connector as claimed in claim 16, wherein said printed circuit board extends in a plane defined by the transverse direction and said front-to-back direction.

18. The electrical connector as claimed in claim 17, wherein each of said terminals further includes a contacting section located around the plug-receiving hole for electrically responding to insertion of the plug.

* * * * *